United States Patent [19]

Orton

[11] 4,057,194

[45] Nov. 8, 1977

[54] PORTABLE FLOUR MILL

[76] Inventor: Roger W. Orton, 2274 W. La Loma Drive, Rancho Cordova, Calif. 95670

[21] Appl. No.: 716,754

[22] Filed: Aug. 23, 1976

[51] Int. Cl.[2] ..... B02C 7/13; B02C 7/14

[52] U.S. Cl. ..... 241/248; 241/259.1; 241/261.2; 241/296

[58] Field of Search ..... 241/244, 245, 248, 259.1, 241/261.3, 296, 261.2

[56] References Cited

U.S. PATENT DOCUMENTS

| | | | |
|---|---|---|---|
| 891,050 | 6/1908 | Durham | 241/261.3 |
| 1,705,996 | 3/1929 | Pope | 241/259.1 X |
| 2,058,175 | 10/1936 | Pinkerton et al. | 241/245 X |
| 3,638,871 | 2/1972 | Barger | 241/259.1 |
| 3,880,367 | 4/1975 | Grover | 241/296 X |
| 3,942,730 | 3/1976 | Coucher | 241/248 |

*Primary Examiner*—Gerald A. Dost

*Assistant Examiner*—Howard N. Goldberg

*Attorney, Agent, or Firm*—Mark C. Jacobs

[57] ABSTRACT

A portable flour mill includes a fixed grinding wheel and a rotatable grinding wheel located inside a box-like housing. The fixed grinding wheel has a smooth and a tapered portion on its grinding face and is fastened to a removable interior wall of the housing. The rotatable grinding wheel has five symmetrically arranged V-shaped radial grooves on its grinding face and is journaled for rotation in a fixed interior wall opposite the fixed grinding wheel. The fixed grinding wheel is provided with an entranceway for receiving the grain which is to be ground. A feed hopper rests on a plate fixed to the removable interior wall and includes an exitway coincident with the entranceway of the fixed wheel. The wheels are selectively spaced apart with each other to grind different types of grain. Means for adjusting the spacing between the two wheels are disclosed.

10 Claims, 5 Drawing Figures

PORTABLE FLOUR MILL

FIELD OF THE INVENTION

This invention relates to flour grinding mills. More particularly, this invention relates to a portable flour grinding mill having a rotatably driven grinding wheel and a fixed grinding wheel spaced apart and adjusting means for selectively moving the rotating grinding wheel toward and away from the fixed grinding wheel. The instant grinding mill can be manually operated if necessary, and a collection means for the newly ground floor is disclosed.

BACKGROUND AND PRIOR ART

The art of milling or comminuting grain by rotary grinding and/or cutting or chopping devices is extremely old and well developed. Conventionally, such mills have been ponderous and slow in operation. There is a need for a small, efficient grain grinder for making whole wheat flour and the like rapidly, grinding it very shortly or immediately before flour is to be used so as to void loss of vitamins and other nutrients in the whole grain. Such devices are finding favor in homes because they make it possible to have freshly ground whole grain flour on demand, which can be made into bread and other products while the flour retains the nutrients which are too often removed in conventional milling or lost in prolonging storage in warehouses and stores.

In U.S. Pat. No. 3,880,367 there is disclosed a portable mill for grinding wheat and other grains comprising two annular grinding stones, one fixed and the other driven, each secured to steel cutting burrs which have their cutting edges substantially in the grinding plane and of which receives grain through a central opening in the burrs. The grain is cut or chopped by secant or non-radial cutter elements closely facing each other and set for shearing action. These force the grain as it is cut radially outward between annular grinding stones which are secured respectively to the stationary and the driven rotary burr. The driven burr is directly connected to the drive shaft of the motor, the motor being provided with a thrust bearing to oppose the thrust between the chopping and grinding elements. A hopper above the stones supplies the feed and includes a removable botton sealed to the sides, and is provided with a metering opening to feed grain at controlled rate into a feed channel connected with the inlet through the stationary burr. The spacing between the two grinding stones is adjusted by moving the mounting block on which the fixed stone is secured.

In U.S. Pat. No. 3,688,996 there is disclosed a flour mill comprising an upstanding box-like housing including a substantially cylindrical abrasive grinding wheel having a multiplicity of spirally disposed tooth-like breaks suitably fastened to one of the sidewalls of the housing, a substantially similar grinding wheel opposingly mounted and journaled for rotation in the sidewall opposite the fixed grinding wheel, and means for driving the rotating grinding wheel. The fixed grinding wheel is provided with an entranceway in one of its walls, a downwardly sloping hopper-like bottom portion is supported by the fixed wheel in the housing and includes an exitway coincident with the entranceway of the fixed wheel. The wheels are selectively spaced apart with respect to each other to grind grain into flour or cereals. The fixed wheel is mounted on a mounting block which has a resilient portion for adjusting the spacing between the respective wheels.

Other examples of portable type flour grinding mills may be found in U.S. Pats. Nos. 585,536; 755,989; 1,033,878; 1,435,130; 2,284,789; and 3,688,996.

It is an object of the present invention to provide a flour mill of simple construction including means operable to control and contain flour and grain within the mill.

A further object of this invention is to provide means for selectively positioning the grinding wheels with respect to each other for grinding flour or cereal.

It is another object of this invention to provide a portable flour mill which can be used effectively to grind a wide variety of grains.

It is still another object of this invention to provide a portable flour mill that can be easily cleaned and/or dissassembled.

It is yet still another object of this invention to provide a new and improved design for the grinding wheels of a portable flour mill.

The present invention will be more fully appreciated upon reference to a detailed description of a presently preferred embodiment thereof.

Generally, the present invention comprises an upstanding box-like housing including a substantially cylindrical abrasive grinding wheel having both flat & tapered areas on its grinding face, suitably fastened to a removable interior wall, a substantially cylindrical abrasive grinding wheel having five symmetrically disposed "v" shaped radial grooves on its grinding face opposingly mounted and jounaled for rotation in an interior wall opposite the fixed grinding wheel, and means for driving the rotating grinding wheel. The fixed grinding wheel is provided with an entranceway in one of its walls. The grinding face of each grinding wheel has a flat outer portion and a concave inner portion. A downwardly sloping feed hopper rests on a plate fixed to the removable interior wall and includes an exit-way coincident with the entranceway of the fixed wheel. The wheels are selectively spaced apart with respect to each other to grind into flour or cereals. Means for adjusting the spacing between the respective wheels by moving the movable wheel is provided in the apparatus here disclosed.

The entranceway aforesaid leads from a loading chamber for the grain or cereal into the grinding area of the mill. Preferably the entry through the fixed stone comprises a circular opening or aperture, the midpoint of which is coincident with the midpoint of the grinding face of the stone.

DESCRIPTION OF PREFERRED EMBODIMENT

Figure 1:
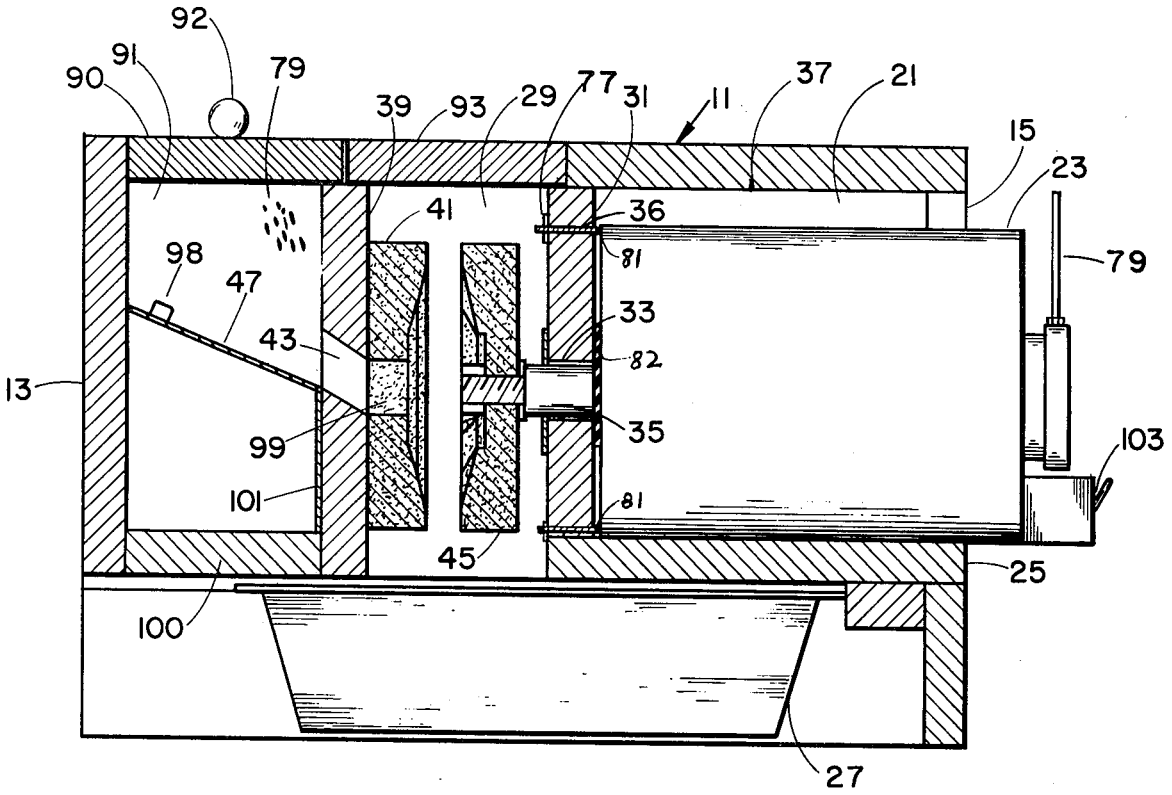
FIG. 1 shows a sectional elevation view of a mill constructed according to the present invention.

Referring now to FIG. 1, the mill of this invention comprises a housing 11 having front and rear walls 13 and 15, side walls 17 and 19 and a motor compartment 21. An electric motor 23, of suitable size and speed, is seated on a support panel 25 inside the housing 11. A bin 27, for receiving the ground flour, is slidably fitted into the lower part of the housing 11. The bin 27 can readily be pulled out for emptying, as needed. Bin 27 is readily made of bent sheet aluminum.

The mill or grinding equipment itself is situated in a compartment 29 above bin 27. This compartment 29 has a fixed vertical interior wall 31 having an aperture 33 through which extends the shaft 35 of motor 23. The motor 23 is fastened to the interior wall 31 by means of four throughbolts 36. A removable interior wall 39 to which is fixed a fixed grinding wheel 41 is suitably bored at 43 to receive a stream of grain 79, to be ground. Removable wall 39 is slidably mounted in vertical grooves number 46 in the side walls 17 and 19. A slide or feed member 47 having a handle 98 rests on the top surface of a plate 101 fixed to the interior wall 39. Plate 101 rests on a mounting block 100. A rotatable wheel 45 is rigidly fixed to the end of shaft 35 of motor 23. No. 45 is also called the moving stone.

Figure 2:
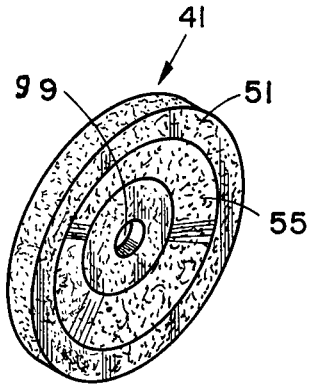
FIG. 2 is a front perspective view of the fixedly secured grinding wheel of this invention.
Figure 3:
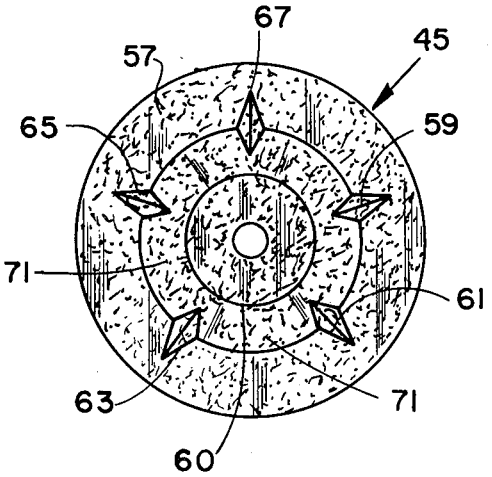
FIG. 3 is a plan view of an unmounted, rotatably mountable grinding wheel employed in this invention.

Referring now to FIG. 2 and 3, wheels 41 and 45 are shown as viewed from their grinding surfaces. Wheel 41 has a central aperture 99 in communication with the bore 43 in removable wall 39. The grinding face of wheel 41 includes a straight flat outer portion 51 and a preferably about 15° inwardly tapering portion which is a frusto conical innr section 55. The taper of the frusto conical inner portion is chosen in a range at an angle of about 12° to 20°. The grinding face of wheel 45 includes a flat outer portion 57 containing a plurality of five "v" shaped radial grooves 59, 61, 63, 65, 67 arranged in a "star like" configuration and a frusto conical inner section 60. The taper of the frusto conical inner section is preferably about 12° to 20°. A portion of the areas 71 between the "v" shaped grooves is preferably recessed. The level of the "v" grooves is about 15°.

Returning now to FIG. 1, other parts that are depicted in the drawing, but which do not readily contribute to the overall operation of the device will not be set forth. Thus door 90 having a handle 92 is completely removeable for the purpose of loading grain particles onto the inclined member 47 constituting hopper 91. The area below the inclined member is empty and serves no function.

Part 93 is a removeable door, without a handle that serves for access to the grinding area 29. A handle is purposely omitted such that one will not be tempted to view the movement of the rotating stone 45 during operation, and risk flour or particulates flying in one's eyes. Number 37 is the fixed top wall which forms part of the motor compartment 21. Part 93 is readily removed after 90 is. Item 103 is the on -off switch for the motor 23, which motor preferably on standard house current of 110 volts.

It has been found to advantage to provide a manually operable crank (not shown) which may be suitably distally fastened such as by a wing nut to the terminal end of the shaft 35 opposite the rotating grinding wheel 45 since sources of electrical energy are frequently interrupted in remote areas where flour mills of the character here disclosed are used. It is to be understood that compound gearing apparatus may additionally be provided to aid in manual operation of the apparatus of this invention.

The distance between the two grinding wheels may be varied by either moving the motor 23 carrying the rotatable wheel toward or away from the fixed wheel 41 or by moving the rotating wheel 45 toward or away from the housing of motor 23. The motor is moved by tightening or loosening the nuts 77 on the throughbolts 36. This serves to properly align vertically the rotating wheel 45. Wheel 45 is moved relative to motor 23 by turning key 79 which applies or releases pressure on a pair of wave springs, 110, but which in fact form a part of bearing assembly 23F shown in FIG. 5.

Figure 5:
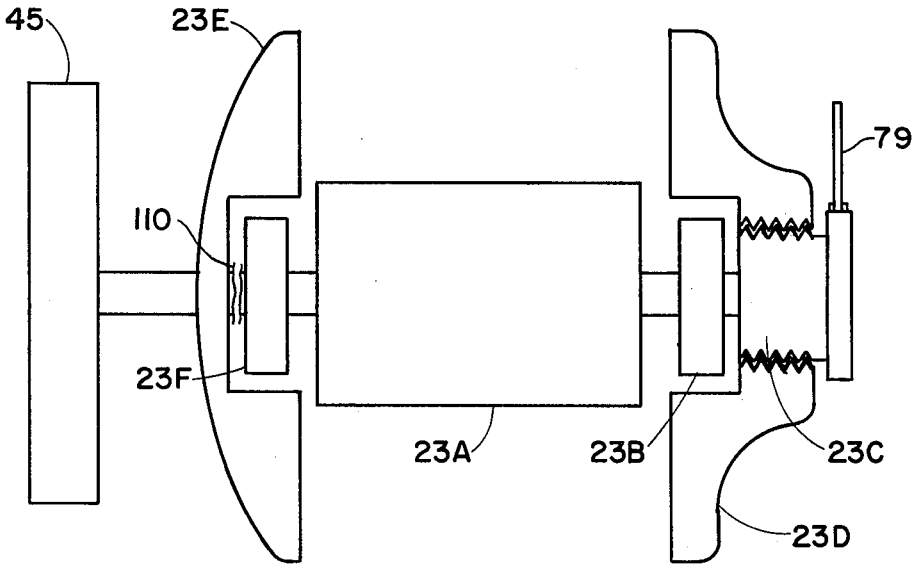
FIG. 5 is a vertical cross section through the motor shaft and the rotatably mounted stone, though graphically depicted.

Turning now to FIG. 5, it is seen that since the fineness of flour ground is controlled by and related to the distance between the two stones, that the fineness can be controlled by moving the rotating stone 45 closer or further away from the fixed stone 41. Thus, rotor assembly 23A can be moved by applying pressure to bearing 23B with threaded plug 23C, by applying leverage to key 79. Screwing plug 23C in and out moves the entire rotor assembly by moving the rotor support bearings 23F and 23 B. Items 23E and D depict the end bells of the motor 23 per se.

Figure 4:
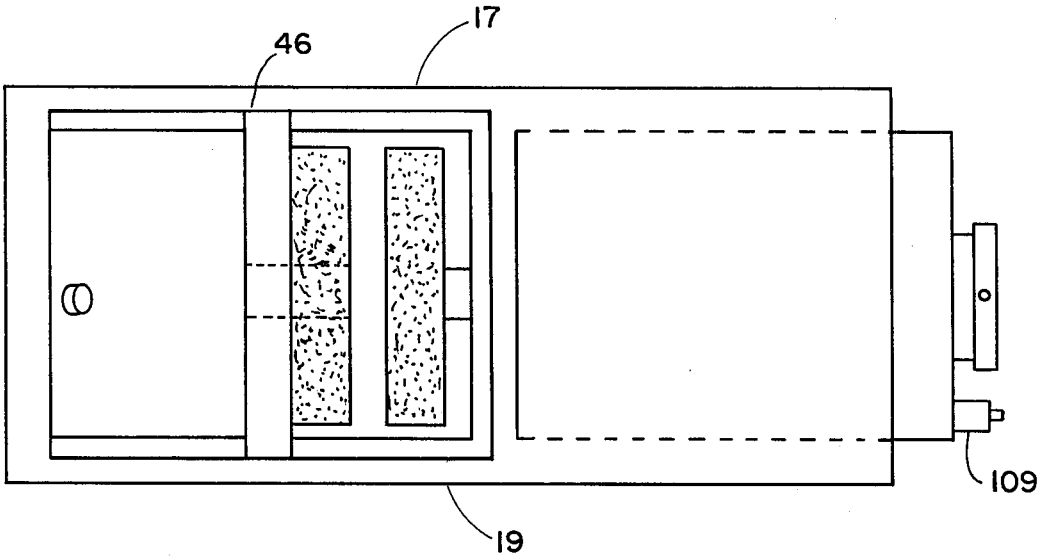
FIG. 4 is a top view of the mill shown in FIG. 1 but with a speed control shown rather than an on-off switch.

FIG. 4 is an overhead view showing door 90 in place, but door 93 having been removed. Since top panel 37 is always fixed in place, that portion of motor 23 which is internal to the cabinetry, is shown in dotted lines. Part 109 is a conventional speed control device, e.g. a rheostat.

As is readily seen FIG. 2 is a perspective view of the fixed stone, while FIG. 3 is a plan view of the rotating stone.

While 103 is shown as an on-off switch, it could just as easily be changed to an infinite stepped rheostat speed control.

One big advantage of the uncomplicated construction of this mill 11, is that it can be sold if desired, in a kit for assembly, or as a completely knocked down kit, with no factory work done to any of the parts, ie. pre-sanding and pre-drilling, as well as being sold as a finished unit ready for use by the homeowner.

Unlike other mills on the market, the instant mill is significantly quieter since most of the motor, other than the cooling area is housed in chamber 21 beneath top panel 37 which insulates the noise away from the surroundings. In addition, since a panel 31, separates the motor from the revolving mill stone, there is little or no chance for flying dust and flour particles to enter the motor and do damage thereto. One other big advantage to the user is that the key sections of the mill dissemble for easy cleaning. These include slide 47, interior panel 39 housing the fixed stone 41, bin 27 and of course doors 90 and 93. The rotating stone is anchored to the motor shaft in a conventional manner, e.g. bolting and can be removed with hand tools, if need be.

While in the preferred embodiment discussed above, the V-shaped grooves or flutes are found in the rotating stone, it is also within the scope of this invention for the flutes to be in the fixed stone. It is further within the scope of the invention for there to be flutes within both stones. It is also to be seen that while the use of five V-shaped grooves has been found to give excellent results with all grains, including corn and wheat, that the use of more or less than five is also contemplated.

Though not required, it is preferred to employ a current sensitive relay as is known in the art, in conjunction with a standard motor to switch from a starting mode to a running mode.

Returning now to FIG. 1 it is seen that in order to align the movable stone viz the fixed stone that it is necessary to align the motor. This can be accomplished by tightening or loosening the locknuts 77 on throughbolts 36 as indicated above. However though not required, it has been found beneficial to employ a small 1 inches ± coil spring on each bolt. The springs act to create a counter-pressure to keep the two stones apart and aid in critical alignment. These springs are designated 81 in FIG. 1.

In addition to the springs, or if desired in place of same, one may utilize an annular gasket such as one of cork or rubber that fits on the shaft 35 at the inner end thereof in abutment with the interior face of the motor. This gasket usually 3/16 inches thick is designated 82. The gasket acts in double duty to firstly seal the motor chamber to keep any dust or fines out, and secondly due to it resiliency the gasket 82 aids in the aligning of the motor. A minor back pressure is created as the gasket desires to resume its normal shape while under compression. When the springs and gasket are employed together it has been found that one can adjust for clearance tolerances in the order of 1/100th inch between the two stones.

Thus it is seen that in adjusting the clearance between the stones, any irregularities in stone surface smoothness can be readily compensated for by adjustment of the movable stone to conform to the fixed stone while maintaining the clearance between them as needed.

Optionally a door, not shown in FIG. 1, can be employed over the passageway of access and egress for bin 27. Such a door aids in the overall esthetics of the apparatus.

It is also to be seen that from the point of view of esthetics, it is also within the scope of this invention to employ rounded corners and edges on the exterior portions of the apparatus that define the housing, as well as to employ various woods, relief carving and other modes of decoration of the housing.

In operation, grain 79 is placed into the hopper portion 91 and caused to flow by gravity down the slide 47 through the exitway 43 and through the bore 99 in the fixed grinding wheel 41 and is caused to be thrown against the grinding face of wheels 41 and 45 in response to the rotation of the wheel 45. Ground grain falls into the bin 27.

Having thus described in detail a preferred apparatus which embodies the concepts and principles of the invention and which accomplishes the various objects, purposes and aims thereof, it is to be appreciated and will be apparent to those skilled in the art that may physical changes could be made in the apparatus without altering the inventive concepts and principles embodied therein. Hence, it is intended that the scope of the invention be limited only to the extent indicated in the appended claims.

I claim:

1. In a flour grinding mill, the combination of an up-standing box-like housing having an opening in the top portion thereof, a removable interior wall, a fixed interior wall, grinding wheels laterally disposed in said housing and spaced apart in said housing with respect to each other, one of said grinding wheels being fixed to the removable interior wall, the other said grinding wheel being journaled for rotation in the fixed interior wall opposite said fixedly mounted grinding wheel, driving means operable to rotatably drive said grinding wheel journaled for rotation in the fixed interior wall, an entranceway in the removable interior wall, a feed hopper inside the housing an exitway coincident with said entrance-way of said fixedly mounted grinding wheel, one of said grinding wheels comprising a substantially cylindrical body portion having a grinding face including at least one radially extending "v" shaped groove.

2. The apparatus of claim 1 wherein the wheel rigidly secured to the removable interior wall is the fixed wheel and the wheel journaled for rotation in the fixed wall is the rotating wheel.

3. The apparatus of claim 2 including adjusting means connected to the driving means and the fixed interior wall for moving said rotating wheel toward and away from said fixed grinding wheel.

4. The apparatus of claim 3 wherein the movable wheel has five symmetrically disposed "v" shaped radial grooves.

5. The apparatus of claim 4 and wherein said adjusting means comprises a plurality of throughbolts connected to said driving means and said fixed interior wall.

6. The apparatus of claim 5 and wherein said driving means is a motor.

7. The apparatus of claim 6 and wherein the grinding face of each wheel includes a flat outer section and a concave frusto conical inner section.

8. The apparatus according to claim 7 and further including spring means located between the rotatable wheel and the housing of the motor.

9. The apparatus of claim 5 further including a motor speed control means.

10. The apparatus of claim 5 further including a resilient gasket means for use in aligning the motor.

* * * * *